US009850791B2

(12) United States Patent
Gokan

(10) Patent No.: US 9,850,791 B2
(45) Date of Patent: Dec. 26, 2017

(54) OIL JET DEVICE

(71) Applicant: HONDA MOTOR CO., LTD., Tokyo (JP)

(72) Inventor: Yoshitsugu Gokan, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 1 day.

(21) Appl. No.: 15/079,755

(22) Filed: Mar. 24, 2016

(65) Prior Publication Data

US 2016/0290188 A1 Oct. 6, 2016

(30) Foreign Application Priority Data

Mar. 30, 2015 (JP) ..... 2015-069594

(51) Int. Cl.
*F01M 1/08* (2006.01)
*F01M 1/10* (2006.01)

(52) U.S. Cl.
CPC ..... *F01M 1/08* (2013.01); *F01M 1/10* (2013.01); *F01M 2001/083* (2013.01); *F01M 2001/1085* (2013.01)

(58) Field of Classification Search
CPC ..... F01M 1/18; F01M 1/10; F01M 2001/083; F01M 2001/1085
See application file for complete search history.

(56) References Cited

U.S. PATENT DOCUMENTS 4,206,726 A * 6/1980 Johnson, Jr. ..... F01P 3/08 123/41.35
4,862,838 A * 9/1989 Hodgkins ..... F01P 3/08 123/41.35
4,995,346 A * 2/1991 Hudson, Jr. ..... F01P 3/08 123/41.35

FOREIGN PATENT DOCUMENTS

JP 54-164328 U 11/1979
JP 2011-94519 A 5/2011

* cited by examiner

*Primary Examiner* — Kevin A Lathers
(74) *Attorney, Agent, or Firm* — Westerman, Hattori, Daniels & Adrian, LLP

(57) ABSTRACT

Oil jet device including a main body and having a fluid communication passage held in fluid communication with an oil passageway, a nozzle pipe having an oil ejection port, a check valve opening and closing the fluid communication passage when a check ball and a valve seat which are disposed in the main body abut against each other, and a filter having a fluid communication hole and being disposed upstream of the check valve, wherein the inside diameter of the valve seat is smaller than the inside diameter of the filter, and the valve seat has an upstream end wall surface facing at least some of the fluid communication holes, and the upstream end wall surface includes a slanted surface arranged such that the cross-sectional area of an oil channel is progressively smaller in a direction from an upstream region toward a downstream region of the oil channel.

8 Claims, 12 Drawing Sheets

OIL JET DEVICE

FIELD OF THE INVENTION

This application relates to a cooling structure for an internal combustion engine, and more particularly to an oil jet device for cooling an internal combustion engine with oil jets injected from behind a piston.

BACKGROUND OF THE INVENTION

As a cooling device for a piston of a conventional internal combustion engine, there is known an oil jet device in which a nozzle pipe providing a cooling oil channel held in fluid communication with an oil passageway in the internal combustion engine extends to the back of the piston, and oil is ejected from the nozzle pipe. Japanese Utility Model Laid-Open No. Sho 54-164328 (JP '328) discloses a technology wherein a filter for filtering the oil is disposed in the oil channel to prevent the oil ejection port from being clogged. Japanese Patent Laid-Open No. 2011-94519 (JP '519) reveals a technology wherein a check valve is provided to keep the oil pressure in the oil channel at a level equal to or higher than a predetermined value for thereby achieving the target aiming ability of the ejection (e.g., the ejection of the oil toward an area to be cooled).

SUMMARY OF THE INVENTION

Heretofore, there has been studied an oil jet device which is provided with the effect of the filter disclosed in JP '328 and the effect of the check valve disclosed in JP '519. However, an arrangement which has both the mounting structure of the filter and the structure of the check valve has caused a pressure loss in the oil channel, making it difficult to obtain a desired response performance with respect to the ejection of oil.

One objective of the present invention is to provide an oil jet device which reduces a pressure loss of oil and has an excellent response about the supply of oil.

To achieve this objective, there is provided in accordance with a first aspect of the present invention an oil jet device comprising: a main body mounted on an internal combustion engine and having a fluid communication passage held in fluid communication with an oil passageway defined in the internal combustion engine; a nozzle pipe having an oil ejection port configured to eject oil that has passed through the fluid communication passage; a check valve configured to open and close the fluid communication passage when a valve body and a valve seat which are disposed in the main body abut against each other; and a filter having a fluid communication hole configured to pass the oil therethrough and filter the oil, the filter being disposed upstream of the check valve, wherein an inside diameter of the valve seat is smaller than an inside diameter of the filter, and the valve seat has an upstream end wall surface facing at least some of the fluid communication holes, and the upstream end wall surface includes a slanted surface arranged such that a cross-sectional area of an oil channel is progressively smaller in a direction from an upstream region toward a downstream region of the fluid communication passage.

According to a second aspect of the present invention, in addition to the arrangement according to the first aspect, the filter includes a bottomed hollow cylinder with an open end at one end of a hollow cylindrical outer circumferential wall thereof and a filter surface with the fluid communication hole at the other end thereof, and the filter is housed in the main body with the outer circumferential wall being held in abutment against the upstream end wall surface.

According to a third aspect of the present invention, in addition to the arrangement according to the first aspect, the filter includes a bottomed hollow cylinder with an open end at one end of a hollow cylindrical outer circumferential wall thereof and a filter surface with the thud communication hole at the other end thereof, and the filter is positioned such that an outer circumferential wall of a distal end of the main body is inserted in the outer circumferential wall, and the filter surface is held in abutment against an upstream end of the main body.

According to a fourth aspect of the present invention, in addition to the arrangement according to any one of the first, second, and third aspects, the valve seat is integrally formed with the main body the main body includes a valve body housing disposed downstream of the valve seat, the valve body and an elastic body configured to bias the valve body are inserted through an insertion opening of the valve body housing, and a lid member is press-fitted in the insertion opening.

According to a fifth aspect of the present invention, in addition to the arrangement according to any one of the first, second, and third aspects, the valve seat includes a member separate from the main body and an elastic body configured to bias the valve body and the valve body are inserted through an upstream end opening of the fluid communication passage, and the valve seat is press-fitted in the upstream end opening.

According to a sixth aspect of the present invention, in addition to the arrangement according to the fifth aspect, an inner wall surface that defines the fluid communication passage has a step held in abutment against a downstream end of the valve seat for determining an inserted position of the valve seat.

According to a seventh aspect of the present invention, in addition to the arrangement according to any one of the first through sixth aspects, the fluid communication hole includes a plurality of fluid communication holes defined in the filter surface of the filter in each of outer circumferential and central areas thereof, and a diameter of each of the fluid communication holes is smaller than a diameter of the oil ejection port.

According to the eighth aspect of the present invention, in addition to the arrangement according to any one of the first seven aspects, the main body has an externally threaded surface on the outer circumference of a tubular portion thereof, the internal combustion engine has an internally threaded surface into which the externally threaded surface is threaded, and the main body is fastened and secured to the internal combustion engine by threaded engagement between the externally threaded surface and the internally threaded surface.

According to the first aspect, since the inside diameter of the valve seat is smaller than the inside diameter of the filter, and the upstream end wall surface facing at least some of the fluid communication holes includes the slanted surface arranged such that the cross-sectional area of the oil channel is progressively smaller in the direction from the upstream region toward the downstream region of the oil channel, the cross-sectional area of the channel at the upstream end wall is prevented from being abruptly reduced. As a result, the oil flow that has passed through the fluid communication holes toward the slanted surface gradually joins a straight flow along the slanted surface. Consequently disturbances of the oil flow are avoided immediately below the filter. Therefore, even though the check valve is disposed immediately behind the filter, constricting the fluid communication passage. This stricture is able to reduce the pressure loss caused between the filter and the upstream end wall surface. As a consequence, the oil jet device is of a good response at the time it ejects the oil.

According to the second aspect, the filter includes the bottomed hollow cylinder with the open end at one end of the hollow cylindrical outer circumferential wall thereof and the filter surface with the fluid communication hole at the other end thereof, and the filter is housed in the main body with the outer circumferential wall being held in abutment against the upstream end wall surface of the valve seat. Therefore, the filter and the valve seat are disposed adjacent to each other. As a result, the main body is compact in size. As the filter is housed in the main body, the oil jet device is not only small in size but also can be handled and assembled in position with ease.

According to the third aspect, since the filter includes the bottomed hollow cylinder with the open end at one end of the hollow cylindrical outer circumferential wall thereof and the filter surface with the fluid communication hole at the other end thereof, the outer circumferential wall of the distal end of the main body is mounted so as to be inserted in the outer circumferential wall of the filter. As the filter surface is positioned in abutment against the upstream end of the main body, the filter and the main body can be assembled together with no clearance left therebetween in a compact fashion.

According to the fourth aspect, as the valve seat is integrally formed with the main body, the valve seat is increased in durability and the number of parts of the check valve is reduced, allowing the check valve to be assembled in place with ease. Moreover, since the valve body and the elastic body of the check valve are inserted through the insertion opening of the valve body housing, and the lid member is press-fitted in the insertion opening to close the same, the check valve can be handled as a component assembled in the main body, and hence can be assembled in place with ease.

According to the fifth aspect, the valve seat includes a member separate from the main body. Therefore, the valve seat can be press-fitted into the upstream end opening after the elastic body and the valve body have been inserted through the upstream end opening of the fluid communication passage. No special structure is necessary for assembling the components of the check valve and the filter. Consequently, the main body is prevented from being structurally complex, and the oil jet device is excellent in assemblability and good in productivity.

According to the sixth aspect, since the inner wall surface that defines the fluid communication passage has the step held in abutment against the downstream end of the valve seat for determining the inserted position of the valve seat, the assembled position of the valve seat can easily be determined simply when the valve seat is press-fitted. Consequently, the assemblability of the oil jet device is increased. As the mounted position of the valve seat is accurately established by the position of the step, the process of setting a threshold value for the pressure for opening the check valve is stabilized.

According to the seventh aspect, inasmuch as the plurality of fluid communication holes are defined in the filter surface of the filter in each of outer circumferential and central areas thereof, the entire filter surface is widely used to ensure the flow rate of oil. As the diameter of each of the fluid communication holes is smaller than the diameter of the oil ejection port, the oil ejection port is prevented from being clogged.

According to the eighth aspect, the main body has the externally threaded surface on the outer circumference of the tubular portion thereof, and the internal combustion engine has the internally threaded surface into which the externally threaded surface is threaded. The main body can thus directly be threaded into and secured to the internal combustion engine. Therefore, no separate fastening member is required to fasten the oil jet device, which is thus made compact. As the mounting structure for the main body is made compact, when the oil jet device is to be disposed in position, the oil jet device is prevented from interfering with peripheral members of the internal combustion engine, and the degree of freedom about the installed position of the oil jet device is increased.

DETAILED DESCRIPTION OF THE INVENTION

Embodiments of the present invention will be described below with reference to the accompanying drawings.

An oil jet device according to a first embodiment for an internal combustion engine that is applicable to a motorcycle as a saddle-type vehicle will be described in detail below with reference to FIGS. 1 through 6. Directions such as upward, downward, leftward, and rightward directions in the present description shall be viewed on the accompanying drawings as they are seen in accordance with the directions of the reference symbols.

Figure 1:
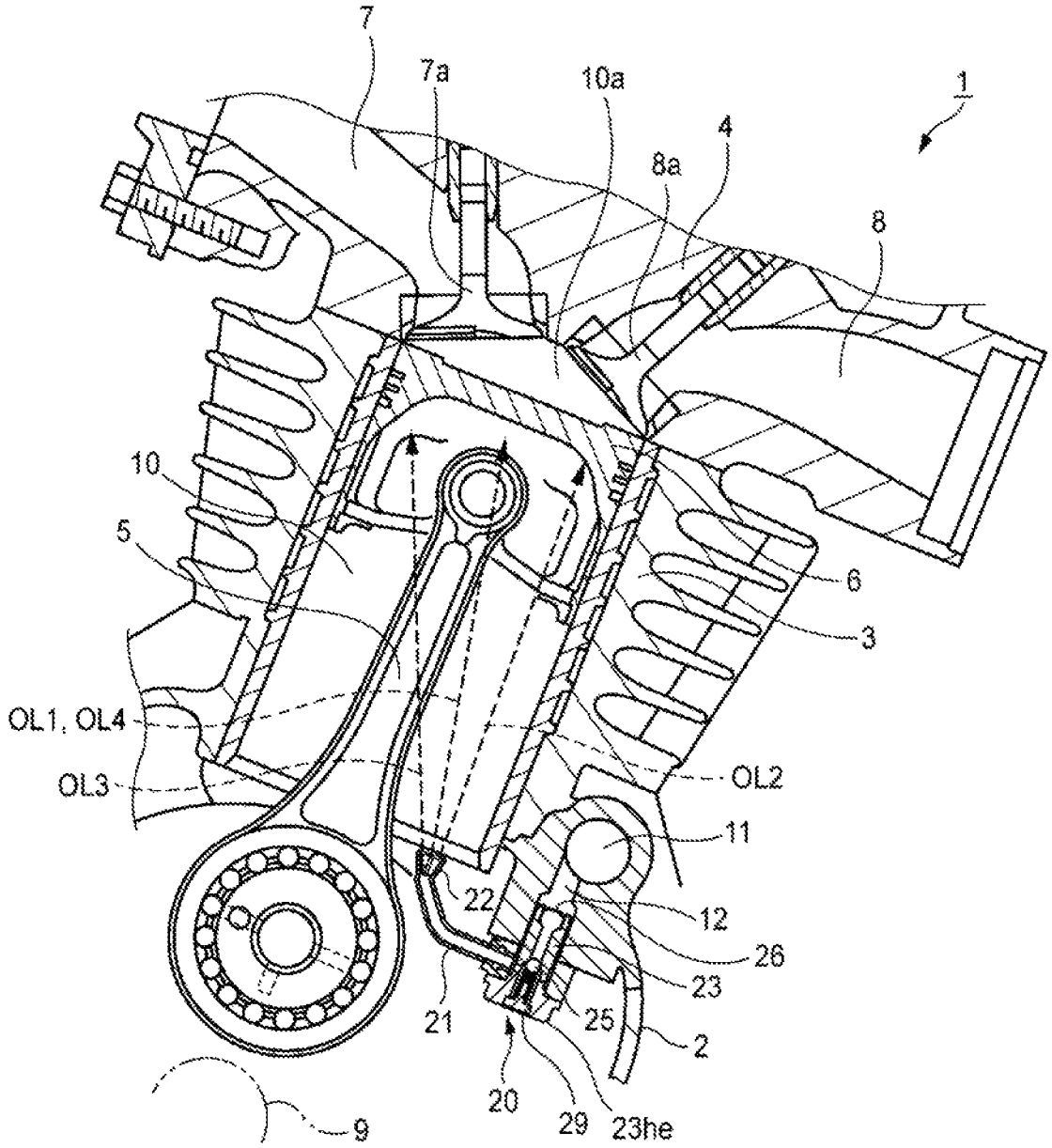
FIG. 1 is a fragmentary cross-sectional view of an internal combustion engine provided with an oil jet device according to a first embodiment, as viewed along an axial direction of a crankshaft.

As shown in FIG. 1, an internal combustion engine 1 according to the present embodiment has a cylinder bore 10 defined by a cylinder 3 and a cylinder head 4 which are oriented upwardly from a crankcase 2. A connecting rod 5 coupled to a crankshaft 9 is coupled to the back side of a piston 6 that is vertically movable in the cylinder bore 10.

The upper surface of the piston 6 and the cylinder bore 10 surround a combustion chamber 10*a* to which there are connected an intake port 7 and an exhaust port 8 through which an air-fuel mixture is introduced and an exhaust gas is discharged at timings corresponding to combustion cycles by opening and closing valves 7*a* and 8*a*.

As shown in FIG. 1, an oil jet device 20 according to the present embodiment is disposed downwardly of the cylinder bore 10. The oil jet device 20 has a main body 23 held in fluid communication with an oil passageway 12 connected to an oil gallery 11 in the internal combustion engine 1, and includes various members, to be described later, on the main body 23. Oil is ejected from the oil jet device 20 through a distal end 22 of a nozzle pipe 21 disposed on a side of a lower end portion of the main body 23 and extending into the cylinder bore 10.

Figure 2:
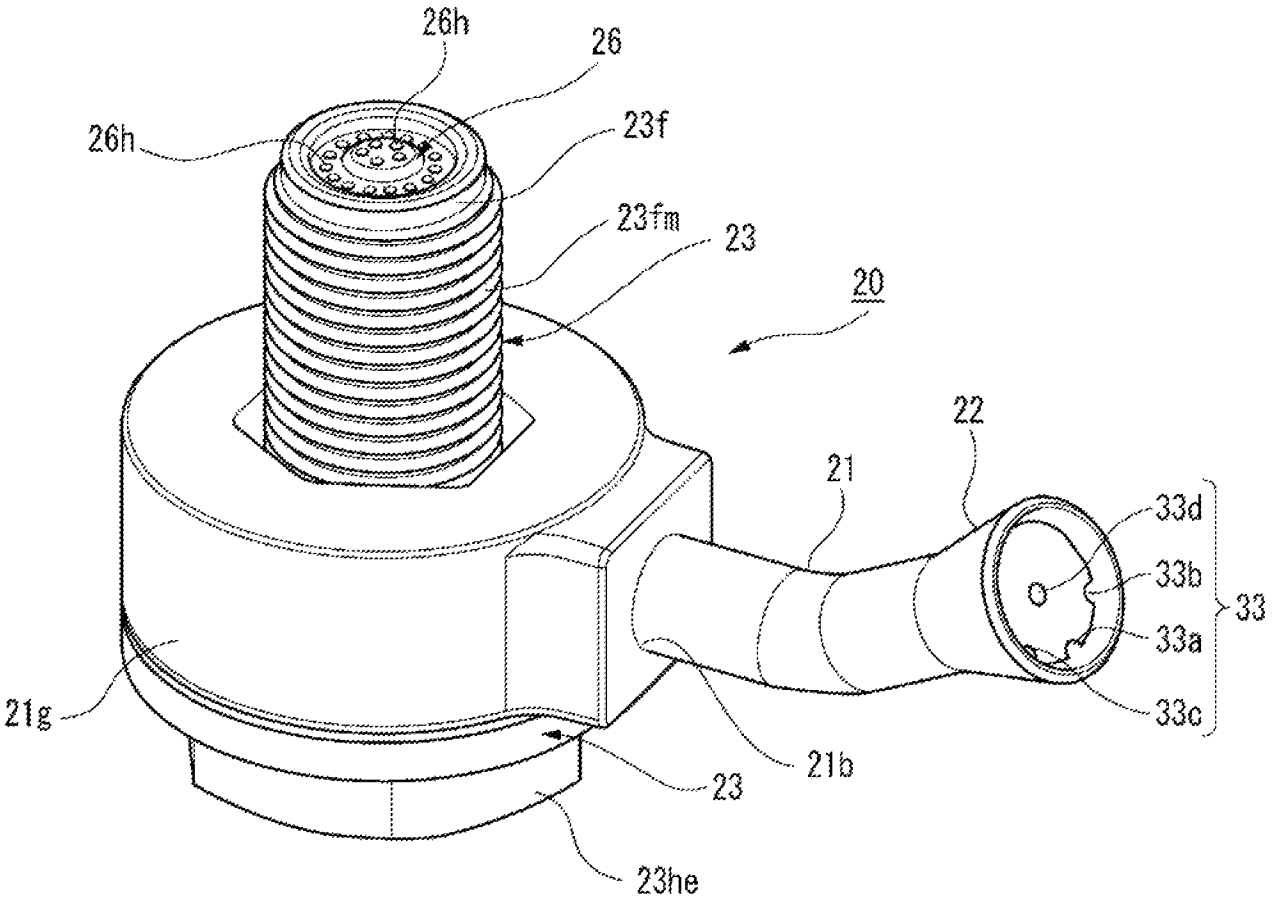
FIG. 2 is a perspective view of the oil jet device shown in FIG. 1.
Figure 3:
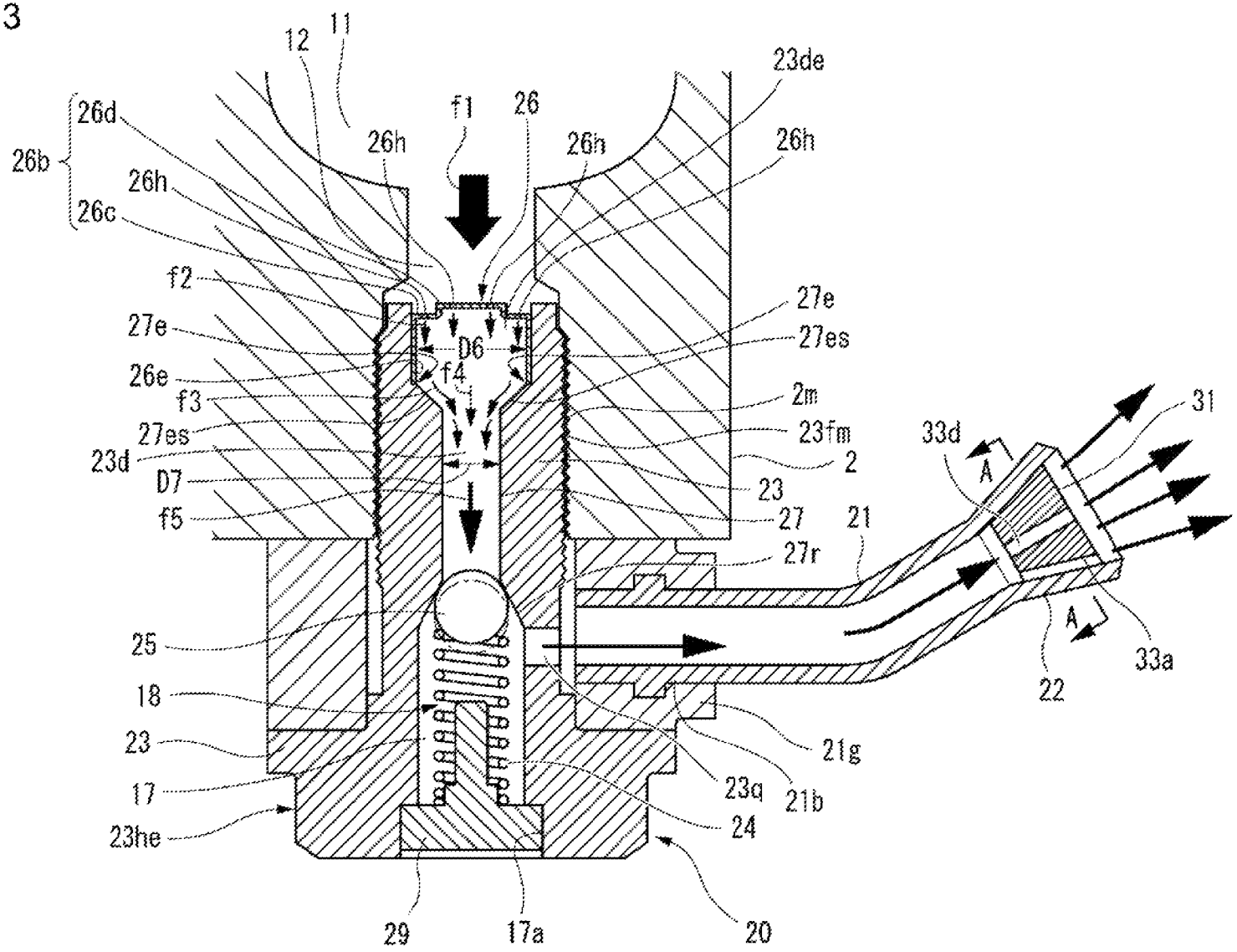
FIG. 3 is a fragmentary cross-sectional view of the oil jet device shown in FIG. 2 which is mounted in place.

As shown in FIGS. 2 and 3, the nozzle pipe 21 has a plurality of oil ejection ports 33 defined in the distal end 22 and a proximal end 21*b* connected in fluid communication with a fluid communication passage 23*d* defined in the main body 23. The proximal end 21*b* is mounted in a holder 21*g* that is mounted on the lower side of the main body 23. As shown in FIG. 3, the holder 21*g* is of a structure that provides fluid communication between a fluid communication side hole 23*q* that is held in fluid communication with the fluid communication passage 23*d* in the main body 23 and the nozzle pipe 21.

As shown in FIGS. 2 and 3, the distal end 22 of the nozzle pipe 21 is of an inverted substantially frustoconical shape. The oil ejection ports 33, which are defined in a distal end surface 31 of the distal end 22, include a total of four oil ejection ports 33 including a first oil ejection port 33*a*, a second oil ejection port 33*b*, a third oil ejection port 33*c* that are positioned along the outer circumferential edge of the distal end surface 31, and a central fourth oil ejection port 33*d*. The oil ejection ports 33 are open upwardly into the cylinder bore 10. The oil that is supplied from an oil pump (not shown) squirts out from the first oil ejection port 33*a*, the second oil ejection port 33*b*, the third oil ejection port 33*c*, and the fourth oil ejection port 33*d* to aid the back side of the piston 6.

The first oil ejection port 33*a*, the second oil ejection port 33*b*, and the third oil ejection port 33*c* have their oil ejection angles set to appropriate values. Therefore, as shown in FIG. 1, a plurality of oil ejection lines OL1, OL2, OL3, and OL4 are formed behind the piston 6 that faces the combustion chamber 10*a* for effectively cooling particular areas.

According to the present embodiment, the nozzle pipe 21 may be made of metal in the form of a carbon steel pipe of SWCH, STKM, or the like, for example.

As shown in FIG. 2, the oil jet device 20 according to the present embodiment has an externally threaded surface 23*fm* on the outer circumference of a tubular portion of the main body 23. As shown in FIG. 3, the crankcase 2 of the internal combustion engine 1 has, in a mount portion thereof, an internally threaded surface 2*m* into which the externally threaded surface 23*fm* is threaded. The main body 23 has on its lower end a head 23*he* in the shape of the head of a hexagon head bolt, for example, for an easy threading action. Therefore, the main body 23 can be threaded into and out of the crankcase 2 by the threading action by the main body 23 itself when it is turned about its own axis. The main body 23 and the holder 21*g* are relatively rotatable, so that the orientation of the nozzle pipe 21 will not be affected by the rotation of the main body 23.

As shown in FIG. 3, the oil jet device 20 according to the present embodiment has a valve body housing 17 below a valve seat 27 within the main body 23. The valve body housing 17 houses therein a check ball 25 as the valve body and a compression spring 24 as an elastic body for pressing the check ball 25. The check ball 25 and a seat surface 27*r* on the lower end of the valve seat 27 jointly provide a check valve 18 for opening and closing the fluid communication passage 23*d*. A filter 26 having a number of fluid communication holes 26*h* for filtering oil is disposed immediately upstream of the valve seat 27 of the check valve 18.

In the check valve 18 configured as described above, when the oil pressure of an oil flow f1 from the oil passageway 12 becomes equal to or greater than a certain level, the check ball 25 is unseated off the seat surface 27*r* of the valve seat 27, allowing the oil to flow into the valve body housing 17 from which the oil is supplied through the fluid communication side hole 23*q* in the valve body housing 17 into the nozzle pipe 21.

Figure 4:
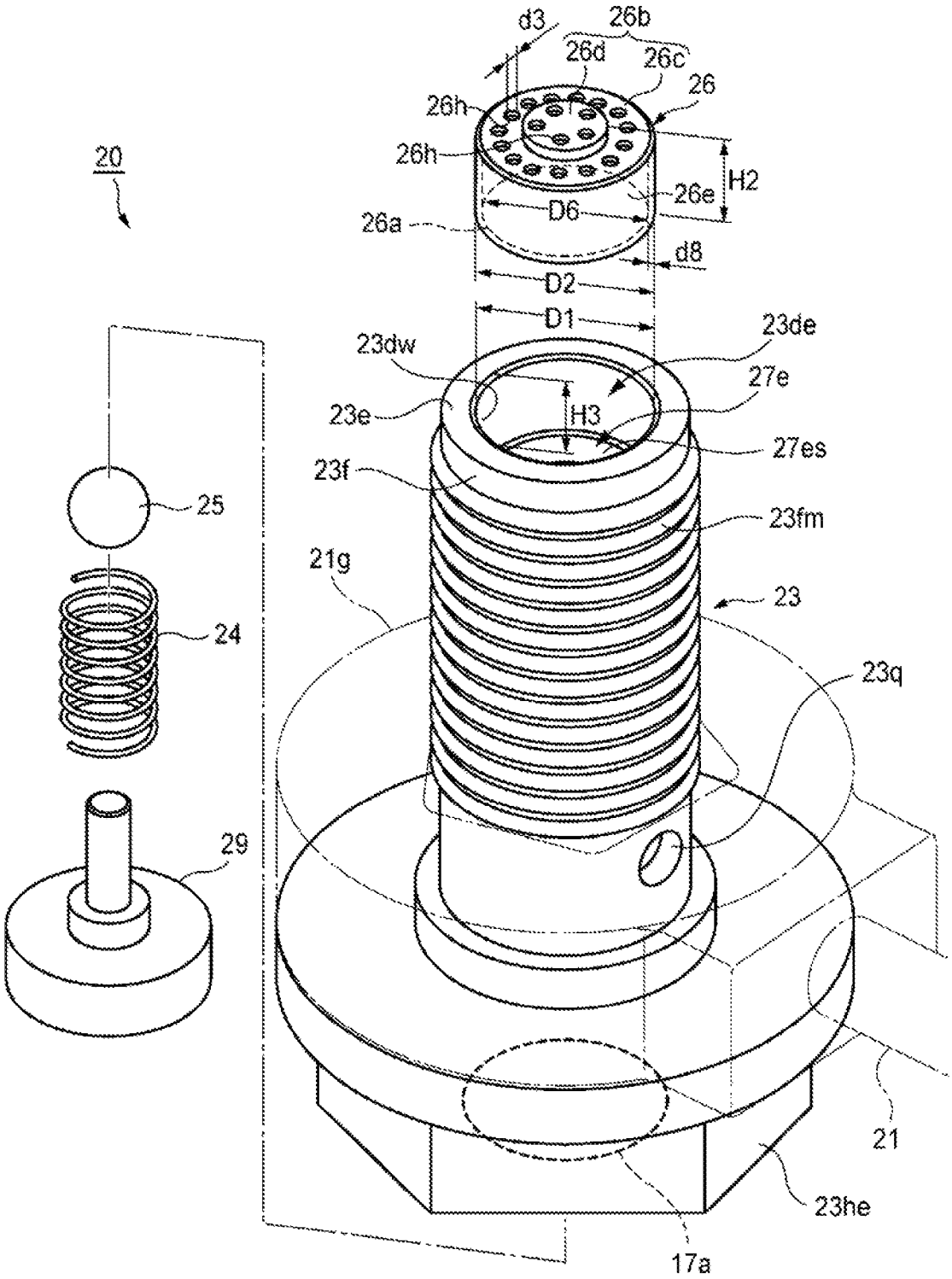
FIG. 4 is an exploded perspective view of the oil jet device shown in FIG. 2.

According to the present embodiment, the filter 26 is mounted in an opening 23*de* in the upstream end of the fluid communication passage 23*d*. As shown in FIG. 4, the filter 26 includes a bottomed hollow cylinder with an open end 26*a* at one end (lower end in FIG. 4) of a hollow cylindrical outer circumferential wall 26*e* thereof and a filter surface 26*b* at the other end thereof (upper end in FIG. 4). The filter surface 26*b* includes a first facet 26*c* near the outer circumferential edge and a second facet 26*d* near the center which lies above the first facet 26*c* (the filter surface 26*b* is projected in the direction of the oil channel at the time the filter 26 is mounted in place). In other words, the filter surface 26*b* is of a two-stepped structure with its central area projecting upwardly. Both the first facet 26*c* and the second facet 26*d* have the plurality of fluid communication holes 26*h*.

Figure 5:
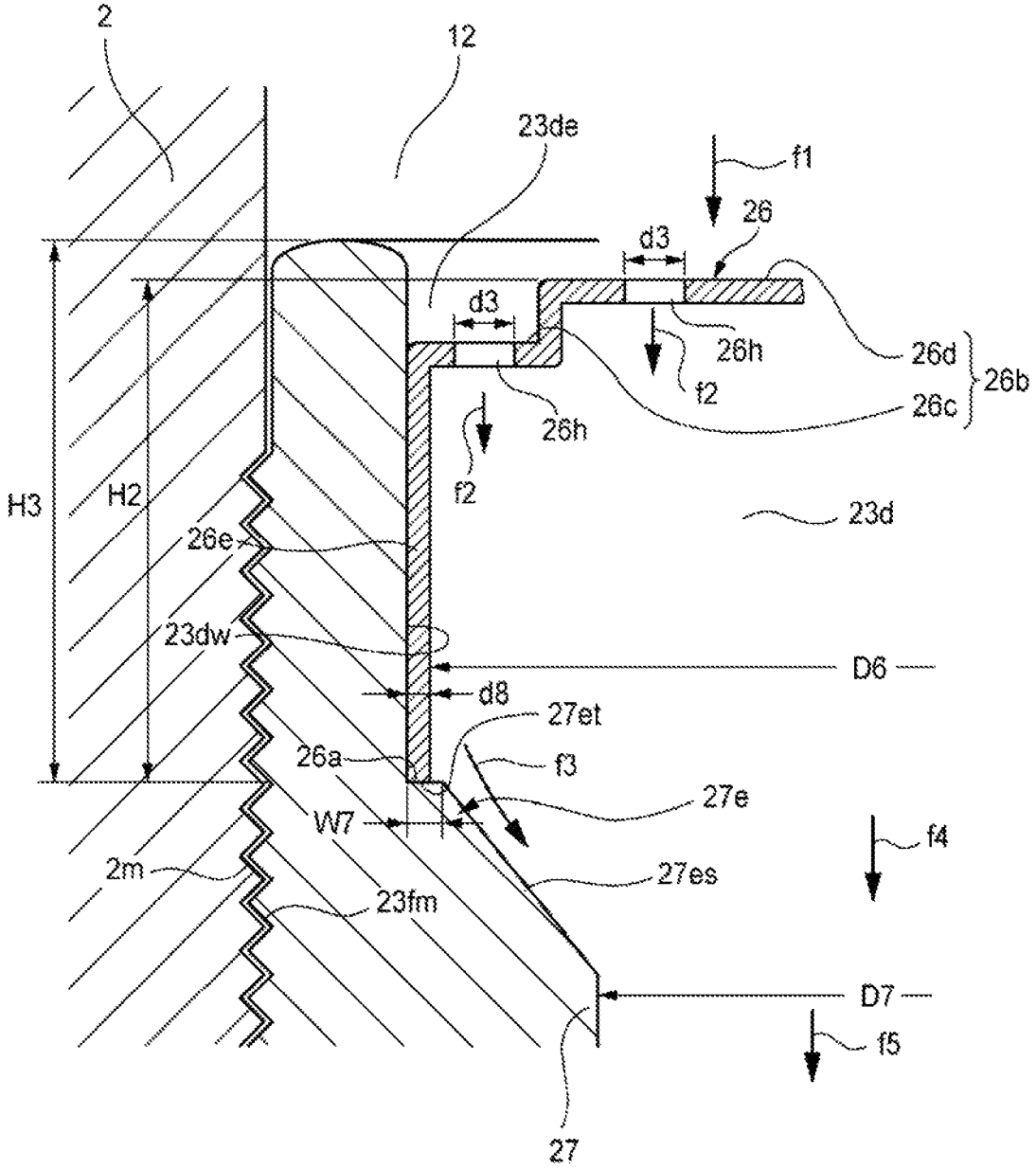
FIG. 5 is an enlarged fragmentary cross-sectional view of the oil jet device shown in FIG. 3 which is mounted in place.
Figure 6:
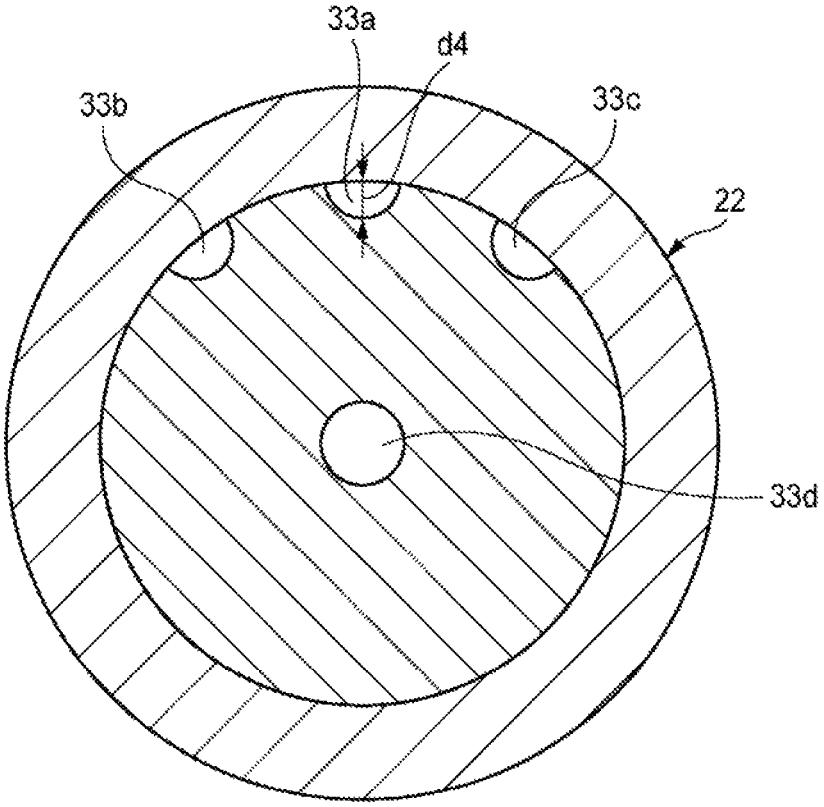
FIG. 6 is a cross-sectional view taken along line A-A of FIG. 3.

As shown in FIG. 5, the filter 26 is mounted in place such that the outer circumferential wall 26*e* is held in abutment against a circumferential edge wall 27*et* of an upstream end wall surface 27*e* of the valve seat 27. The circumferential edge wall 27*et* positions the filter 26 which is inserted. The width W7 of the circumferential edge wall 27*et* is equal to or greater than the thickness d8 of the outer circumferential wall 26*e*. The filter 26 is mounted in place when it is pushed into the upstream end opening 23*de*, e.g., by being lightly press-fitted, for example. Specifically, the outside diameter D2 of the outer circumferential wall 26*e* of the filter 26 is substantially the same as the inside diameter D1 of the upstream end opening 23*de* to make it possible for the filter 26 to be press-fitted into the upstream end opening 23*de*. The axial height H3 of the upstream end opening 23*de* is greater than the height H2 of the outer circumferential wall 26*e*. As a result, the filter 26 is housed in place without projecting from the upstream end opening 23*de* (see FIG. 2).

According to the present embodiment, as described above, the filter 26 is mounted in place by being press-fitted. The filter 26 should be press-fitted into position to the extent that the filter 26 can easily be mounted in or removed from the upstream end opening 26*de* manually by the worker, in an engaging state that may be called a "lightly press-fitted" state. The engaging state that allows the filter 26 to be easily mounted in or removed from the upstream end opening 26*de* makes the filter 26 be easily mounted and removed for better maintenance.

The diameter d3 of each of the fluid communication holes 26*h* of the filter 26 is smaller than the minimum diameter d4 (see FIG. 6) of each of the oil ejection ports 33. Therefore, the oil ejection ports 33 will not be clogged by minute foreign matter that has passed through the fluid communication holes 26*h*.

A situation in which relatively large foreign matter that cannot pass through the fluid communication holes 26*h* is trapped by the filter 26 will be described below. In such a situation, the large foreign matter may block a large area of the filter surface 26*b*. However, as shown in FIGS. 4 and 5, since the filter surface 26*b* is of a two-stepped structure having the first facet 26*c* and the second facet 26*d*, a clearance tends to be created between the foreign matter and the filter surface 26*b* (filtration surface), securing the oil channel. As a result, the coil can continuously be supplied to the piston 6.

The filter surface 26*b* which is recessed and projected in shape is increased in rigidity. Though the oil pressure is expected to rise due to the trap of foreign matter, the increased rigidity of the filter surface 26*b* makes the filter 26 higher in mechanical strength against deformation under the oil pressure buildup.

Figure 7:
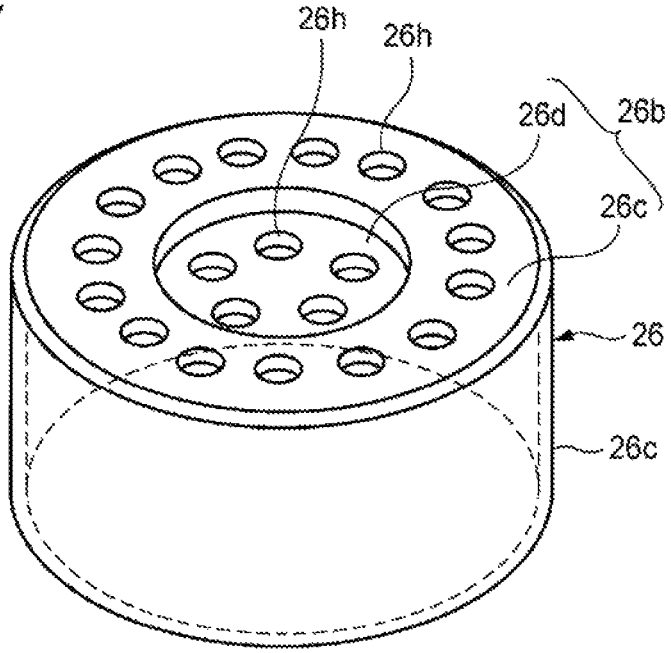
FIG. 7 is a perspective view of a modification of a filter according to the first embodiment.

The recessed and projected structure of the filter 26 according to the present embodiment may be of a shape shown in FIG. 7, for example. The filter 26 shown in FIG. 7 is of such a structure that the second facet 26*d* in the central area of the filter surface 26*b* is recessed downstream in the oil channel from the first facet 26*c* at the time the oil jet device 20 is mounted in place. This structure offers the same advantages as those of the projected structure described above.

As shown in FIGS. 3 and 5 the inside diameter D7 of the valve seat 27 according to the present embodiment is smaller than the inside diameter D6 of the filter 26. The upstream end wall surface 27*e* of the valve seat 27 faces at least some of the fluid communication holes 26*h*. Specifically, the upstream end wall surface 27*e* faces the fluid communication holes 26*h* that are defined in the first facet 26*c* on the outer circumferential area of the filter surface 26*b*. The upstream end wall surface 27*e* includes a slanted surface 27*es*. The slanted surface 27*es* is arranged such that the cross-sectional area of the oil channel is progressively smaller in a direction from an upstream region toward a downstream region of the fluid communication passage 23*d*.

As shown in FIG. 5, since the slanted surface 27*es* of the upstream end wall surface 27*e* faces a portion nearest the wall (close to an inner wall surface 23*dw*) of an oil flow f2 that has passed through the fluid communication holes 26*h* (those fluid communication holes 26*h* in the outermost circumferential area on the left in FIG. 5) of the filter 26, the oil flow near the wall is gradually guided toward the central area as a slanted flow f3.

In the oil jet device 20 according to the present embodiment, the valve seat 27 is integrally formed with the main body 23. Therefore, the check ball 25 and the compression spring 24 that are to be placed in the valve body housing 17 disposed downstream of the valve seat 27 are inserted through an insertion opening 17*a* defined in the lower end of the main body 23. After the check ball 25 and the compression spring 24 have been inserted into the valve body housing 17, a lid member 29 for closing the insertion opening 17*a* is press-fitted into position.

According to the present embodiment which is arranged as described above, the upstream end wall 27*e* of the valve seat 27 which faces the fluid communication holes 26*h* has the slanted surface 27*es* that is arranged such that the cross-sectional area of the oil channel is progressively smaller in the direction from the upstream region toward the downstream region of the oil channel. The cross-sectional area of the oil channel at the upstream end wall 27*e* is thus prevented from being abruptly reduced. With this structure, as the oil flow f2 that has passed through the fluid communication holes 26*h* toward the slanted surface 27*es* partly forms the slanted flow f3 gradually oriented toward the central area along the slanted surface 27*es* and gradually joins a straight flow f4 that flows in the vicinity of the central area, disturbances of the oil flow are avoided immediately below the filter 26. Consequently, an undisturbed stable flow f5 is ensured in a portion of the fluid communication passage 23*d* where the cross-sectional area of the oil channel is small.

Therefore, even though the check valve 18 is disposed immediately behind the filter 26, constricting the fluid communication passage 23*d*, according to the present embodiment, this structure is able to reduce the pressure loss caused between the filter 26 and the upstream end wall surface 27*e*. As a consequence, the oil jet device 20 is of a good response at the time it ejects the oil.

According to the present embodiment, the filter 26 is in the form of the bottomed hollow cylinder with the open end 26*a* at one end of the hollow cylindrical outer circumferential wall 26*e* thereof and the filter surface 26*b* with the fluid communication holes 26*h* at the other end thereof. Furthermore, since the filter 26 is disposed such that the outer circumferential wall 26*e* thereof is held in abutment against the upstream end wall surface 27*e* of the valve seat 27, the filter 26 and the valve at 27 are disposed adjacent to each other. As a result, the main body 23 is compact in size. As the filter 26 is housed in the main body 23, the oil jet device 20 is not only small in size but also can be handled and assembled in position with ease.

According to the present embodiment, because the valve seat 27 is integrally formed with the main body 23, the valve seat 27 is increased in durability, and the number of parts of the check valve 18 is reduced, allowing the check valve 18 to be assembled in place with ease. The check ball 25 and the compression spring 24 of the check valve 18 are inserted through the insertion opening 17*a* of the valve body housing 17, and then the lid member 29 is press-fitted into the insertion opening 17*a* to close the same. Therefore, the check valve 18 can be handled as a component assembled in the main body 2 and hence can be assembled in place with ease.

According to the present embodiment, since the plurality of fluid communication holes 26*h* are defined in the filter surface 26*b* in each of the outer circumferential and central areas thereof the entire filter surface 26*b* is widely used to ensure the flow rate of oil. As the inside diameter of each of the fluid communication holes 26*h* is smaller than the inside diameter of each of the oil ejection ports 33, the oil ejection ports 33 are prevented from being clogged.

According to the present embodiment, the externally threaded surface 23*fm* is provided on the outer circumference of the tubular portion of the main body 23, and the internally threaded surface 2*m* into which the externally threaded surface 23*fm* is threaded is provided in the internal combustion engine 1. The main body 23 can thus directly be threaded into and secured to the internal combustion engine 1. Therefore, no separate fastening member is required to fasten the oil jet device 20, which is thus made compact. As the mounting structure for the main body 23 is made compact, when the oil jet device 20 is to be disposed in position, the oil jet device 20 is prevented from interfering with peripheral members of the internal combustion engine 1, and the degree of freedom about the installed position of the oil jet device 20 is increased.

A second embodiment of the present invention will be described below with reference to FIGS. 8 and 9.

Those parts of an oil jet device 20 according to the second embodiment which are identical to those of the first embodiment will not be described in detail below, and components and peripheral components which are different from those of the first embodiment will be described below. FIG. 8 is a fragmentary cross-sectional view of the oil jet device according to the second embodiment which is mounted in place.

Figure 8:
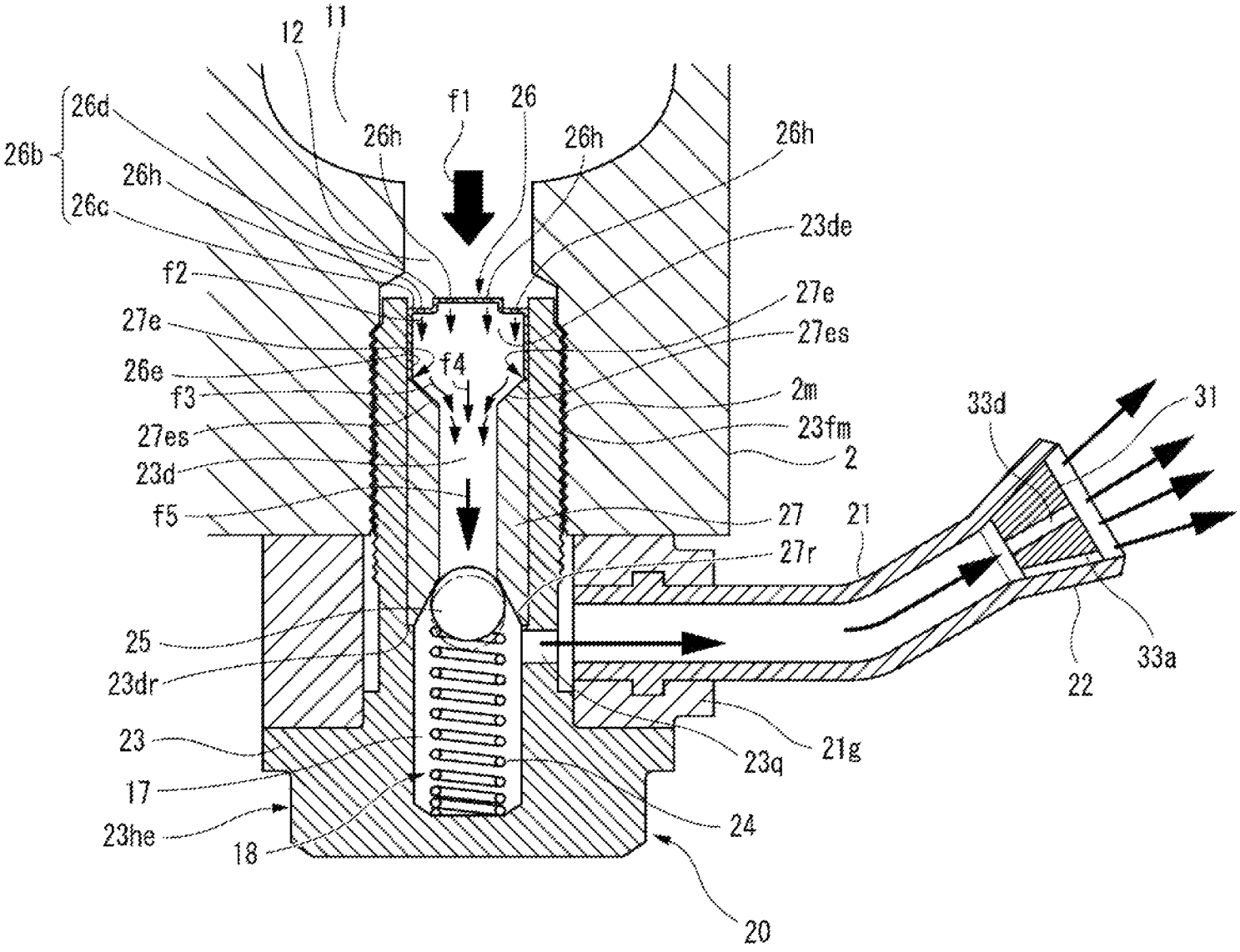
FIG. 8 is a fragmentary cross-sectional view of an oil jet device according to a second embodiment which is mounted in place.

As shown in FIG. 8, the oil jet device 20 according to the present embodiment is similar to the oil jet device 20 according to the first embodiment as to the structure wherein the filter 26 is mounted in the main body 23, but is different therefrom as to the structure of the valve seat 27 and the valve body housing 17. According to the present embodiment, the valve seat 27 includes a member separate from the main body 23, and the valve body housing 17 has no insertion opening 17*a*. The valve body housing 17 is formed by press-fitting the valve seat 27 through the upstream end opening 23*de* of the fluid communication passage 23*d*. Specifically, after the compression spring 24 and the check hall 25 have been inserted through the upstream end opening 23*de*, the valve seat 27 is press-fitted into the upstream end opening 23*de*, making up the check valve 18.

Figure 9:
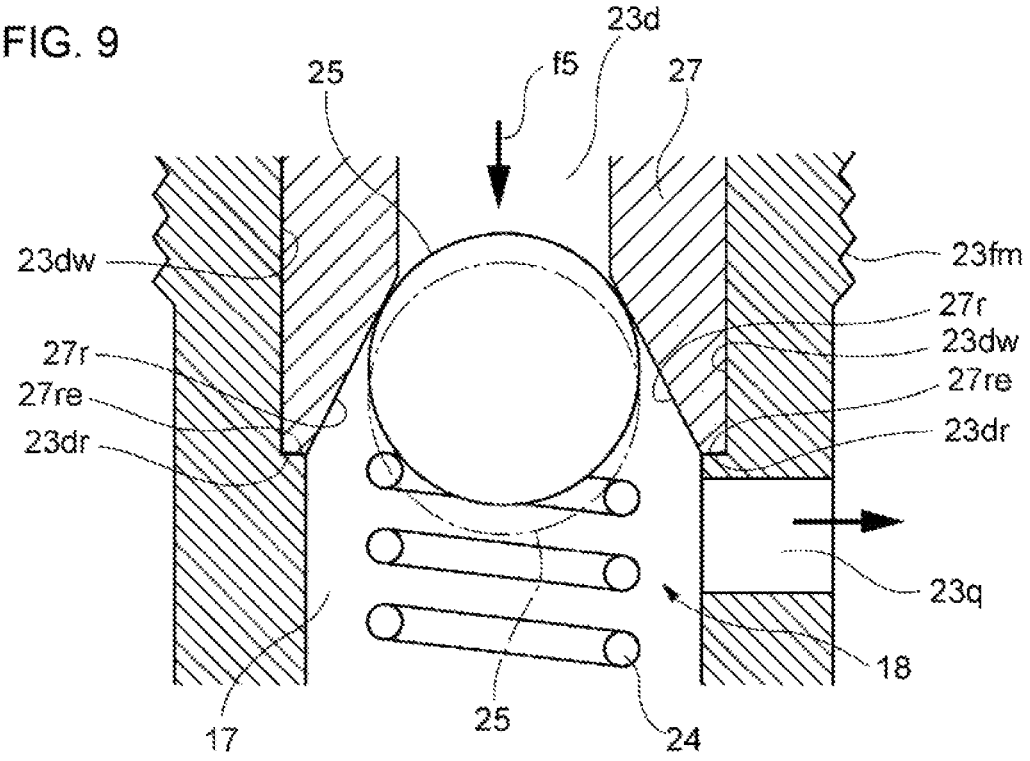
FIG. 9 is an enlarged fragmentary cross-sectional view of the oil jet device shown in FIG. 8.

According to the present embodiment, as shown in FIG. 9, the inner wall surface 23*dw* that defines the fluid communication passage 23*d* has a step 23*dr* which reduces the inside diameter of the fluid communication passage 23*d*. When the valve seat 27 is inserted, the step 23*dr* engages a downstream end 27*re* of the valve seat 27, thereby determining an inserted position of the valve seat 27.

According to the present embodiment, therefore, as the valve seat 27 includes a member separate from the main body the valve seat 27 can be press-fitted into the upstream end opening 23*de* of the fluid communication passage 23*d* after the compression spring 24 and the check ball 25 have been inserted through the upstream end opening 23*de*. No special structure is necessary for assembling the components of the check valve 18 and the filter 26. Consequently, the main body 23 is prevented from being structurally complex, and the oil jet device 20 is excellent in assemblability and good in productivity.

According to the present embodiment, moreover, since the inner wall surface 23*dw* that defines the fluid communication passage 23*d* has the step 23*dr* held in abutment against the downstream end 27*re* of the valve seat 27 to determine the inserted position of the valve seat 27, the assembled position of the valve seat 27 can easily be determined simply when the valve seat 27 is press-fitted. Consequently, the assemblability of the oil jet device 20 is increased. As the mounted position of the valve at 27 is accurately established by the position of the step 23*dr*, the process of setting a threshold value for the pressure for opening the check valve 18 is stabilized.

A third embodiment of the present invention will be described below with reference to FIG. 10.

Those parts of an oil jet device 20 according to the third embodiment which are identical to those of the second embodiment will not be described in detail below, and components and peripheral components which are different from those of the second embodiment will be described below. FIG. 10 is a fragmentary cross-sectional view of the oil jet device according to the third embodiment which is mounted in place.

Figure 10:
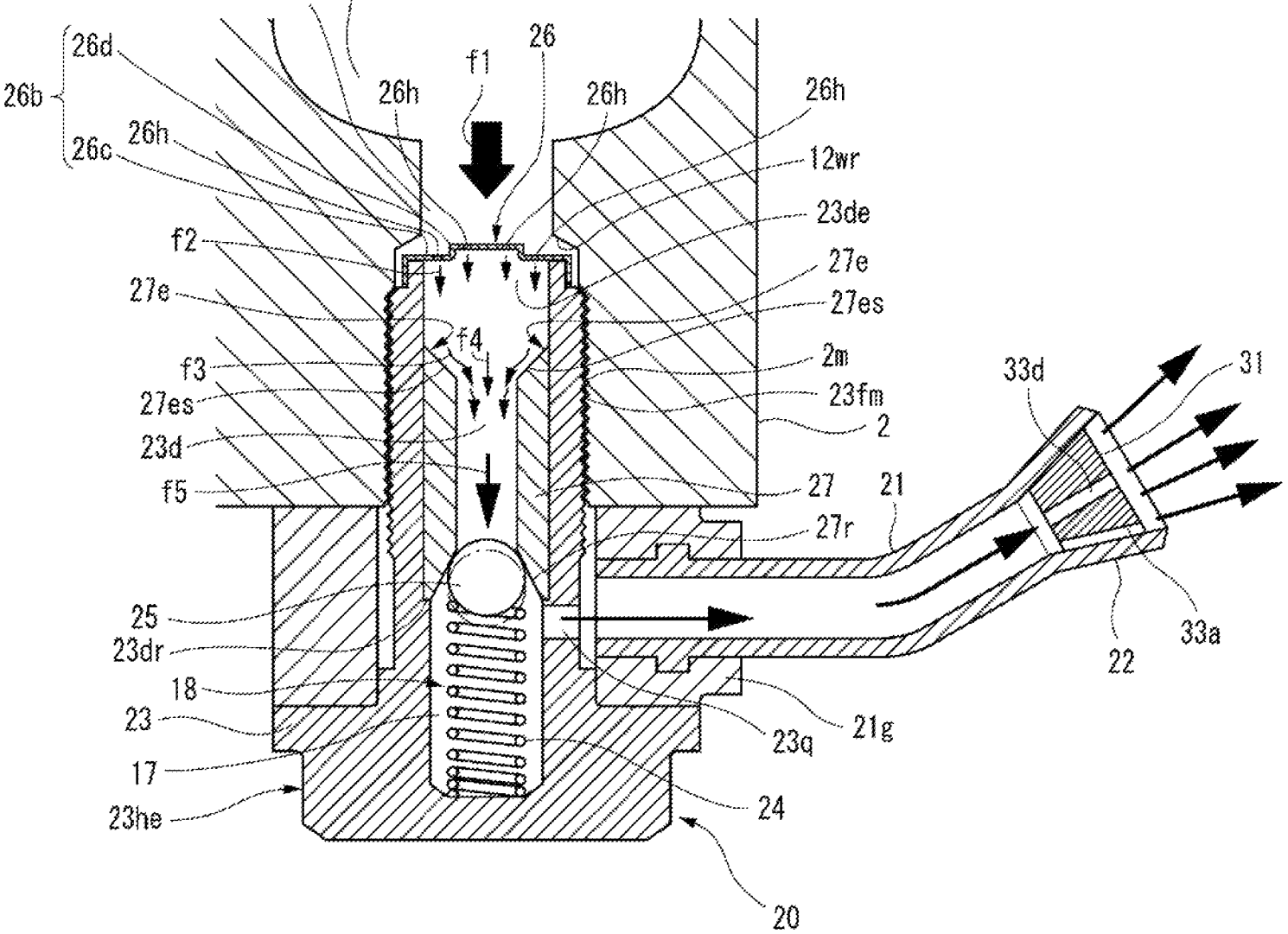
FIG. 10 is a fragmentary cross-sectional view of an oil jet device according to a third embodiment which is mounted in place.

The oil jet device 20 shown in FIG. 10 is of a structure identical to the structure of the second embodiment except for a so-called externally installed filter structure wherein the filter 26 is disposed outside of the main body 23.

The filter 26 according to the present embodiment is of such a structure that an outer circumferential wall 23*f* of the distal end of the main body 23 is inserted in the outer circumferential wall 26*e* of the filter 26. The filter 26 is positioned when the filter surface 26*b* is held in abutment against an upstream end 23*e* of the main body 21.

According to the present embodiment, the outer circumferential wall 26*e* of the filter 26 is fitted over the outer circumferential wall 23*f* of the distal end of the main body 23. As the main body 23 is threaded into place, it has the following structure described below.

The outside diameter of the outer circumferential wall 26*e* is slightly smaller than the outside diameter of the externally threaded surface 23*fm*. When the externally threaded surface 23*fm* is threaded into the internally threaded surface 2*m*, therefore, the filter 26 does not interfere with the internally threaded surface 2*m*.

According to the present embodiment, as is the case with the internally installed filter structure, the filter 26 is press-fitted over the outer circumferential wall 23*f* of the distal end of the main body 23 to the extent that the filter 26 can easily be mounted and removed manually by the worker.

Since the filter 26 is fitted over the outer circumferential wall 23*f* of the upstream distal end of the main body 23 through removable engagement to the main body 23, the oil jet device 20 can easily be mounted on and removed from the internal combustion engine 1 while the filter 26 is being held on the main body 23.

For a maintenance process for replacing the filter 26, for example, the filter 26 can directly be accessed simply by removing the main body 23 of the oil jet device 20 from the internal combustion engine 1. Furthermore, as the filter surface 26*h*, which is part of the filter 26, is positionally limited by a wall surface 12*wr* in the oil passageway 12 which is disposed upstream of body 23, the filter 26 will not be dislodged into a space near the piston.

According to the present embodiment, furthermore, the filter 26 is in the form of a bottomed hollow cylinder with the open end 26*a* at one end of the hollow cylindrical outer circumferential wall 26*e* thereof and the filter surface 26*b* with the fluid communication holes 26*h* at the other end thereof. Therefore, the filter 26 is mounted in place such that the outer circumferential wall 23*f* of the distal end of the main body 23 is inserted in the outer circumferential wall 26*e* of the filter 26. Since the filter 26 is positioned with the filter surface 26*b* being held in abutment against the upstream end 23*e* of the main body 23, the filter 26 and the main body 23 can be assembled together with no clearance left therebetween in a compact fashion.

A fourth embodiment of the present invention will be described below with reference to FIG. 11.

Those parts of an oil jet device 20 according to the fourth embodiment which are identical to those of the first embodiment will not be described in detail below, and components and peripheral components winch are different from those of the first embodiment will be described below. FIG. 11 is a fragmentary cross-sectional view of the oil jet device according to the fourth embodiment which is mounted in place.

Figure 11:
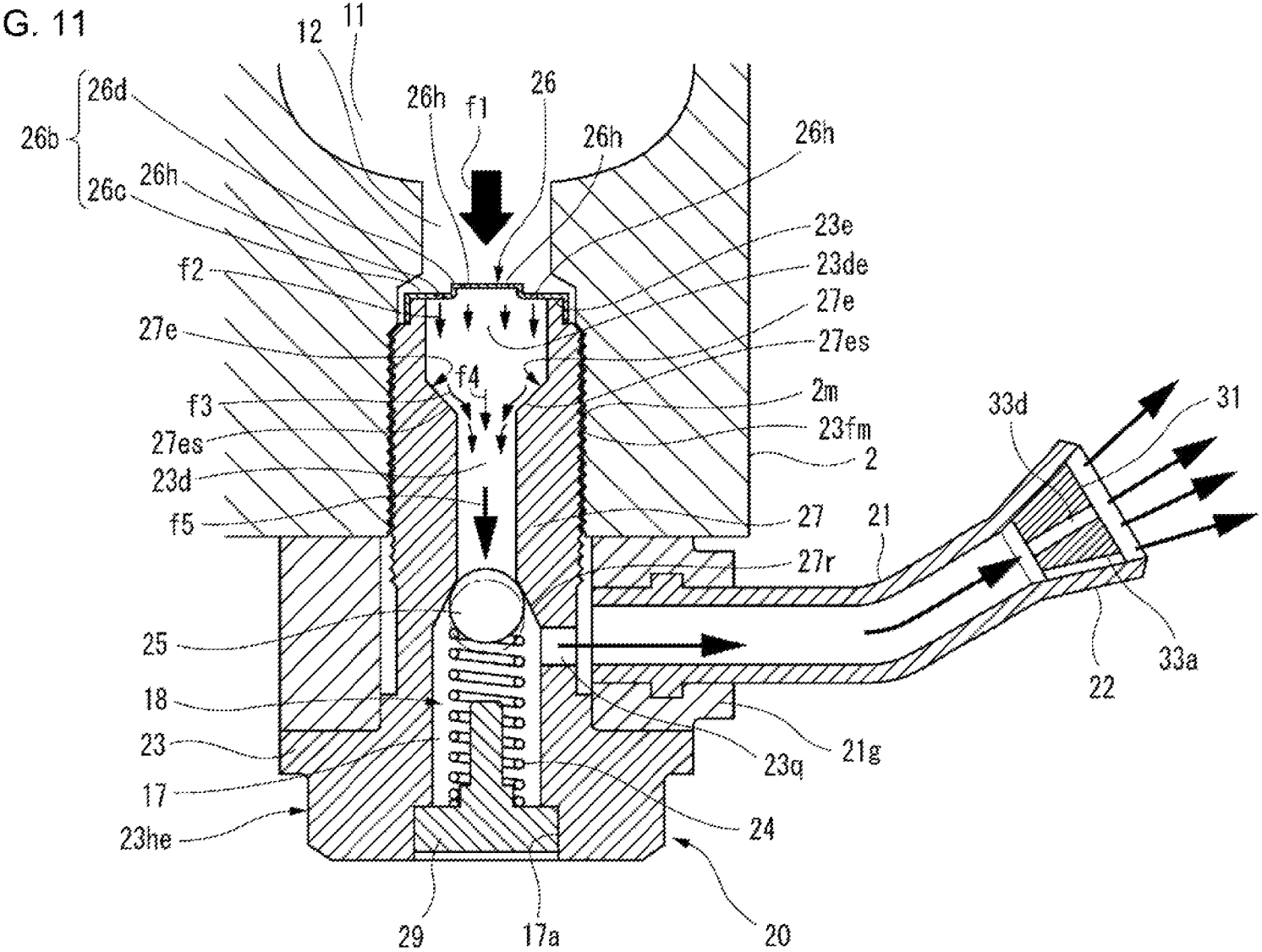
FIG. 11 is a fragmentary cross-sectional view of an oil jet device according to a fourth embodiment which is mounted in place.

The oil jet device 20 shown in FIG. 11 is of a structure identical to the structure of the first embodiment except for a so-called externally installed filter structure wherein the filter 26 is disposed outside of the main body 23.

According to the present embodiment, the valve seat 27 is integrally formed with the main body 23, and as is the case with the third embodiment described above, the filter 26 is of such a structure that the outer circumferential wall 23*f* of the distal end of the main body 23 is inserted in the outer circumferential wall 26*e* of the filter 26.

According to the present embodiment, since the filter 26 is mounted on the outer circumferential wall 23*f* of the distal end of the main body 23, the circumferential edge wall 27*et* (see FIG. 5) for abutting against the outer circumferential wall 26*e* of the filter 26 may be dispensed with. Therefore, the slanted surface 27*es* may be formed so as to extend directly from the inner wall surface 23*dw* of the fluid communication passage 23*d*, resulting in a structure which maximizes the reduction of the pressure loss.

Figure 12:
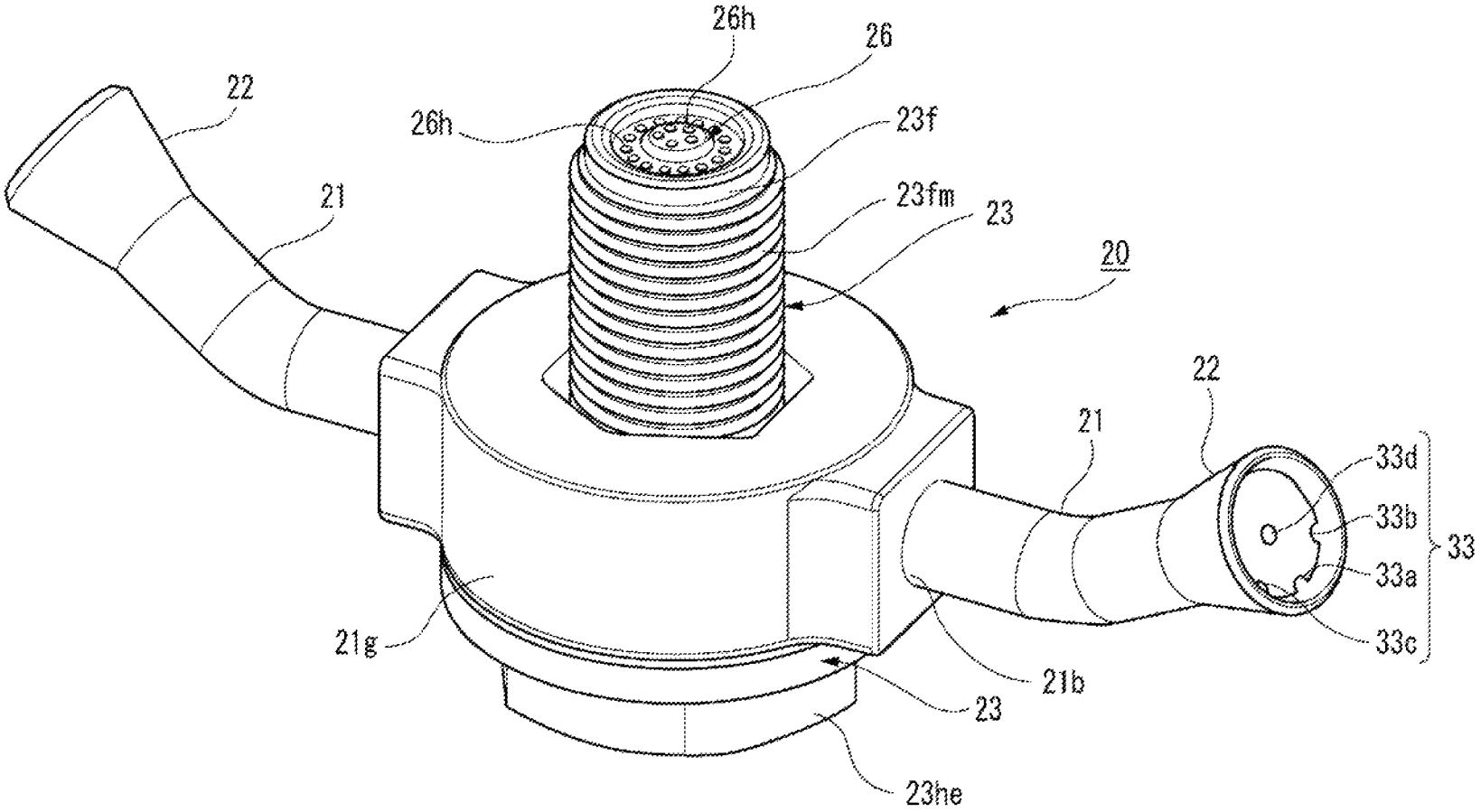
FIG. 12 is a perspective view of an oil jet device according to a fifth embodiment.

A fifth embodiment of the present invention will be described below with reference to FIG. 12.

An oil jet device 20 according to the fifth embodiment has a basic structure having the filter 26 and the main body 23 which includes the check valve 28, etc., which may be either one of the structures according to the first through fourth embodiments described above. However, the oil jet device 20 according to the fifth embodiment has two nozzle pipes 21 mounted on the holder 21*g*. Such a structure is made possible by constructing the main body 23 and the holder 21*g* as separate members.

By thus using the main body 23 of the same structure and modifying the holder 21*g* and the nozzle pipes 21 mounted on the holder 21*g*, the shape and number of the nozzle pipes 21 can appropriately be changed. Therefore, the oil jet device 20 which is easily capable of adapting itself to the structure of the internal combustion engine 1 is provided.

In the first through fifth embodiments described above, the present invention has been described as a cooling device for a piston in an internal combustion engine for use on a motorcycle. The present invention is not limited to such an application, but can be incorporated in various internal combustion engines for use on ATVs, four-wheeled motor vehicles, etc.

In the above embodiments, the slanted surface 27*es* is formed as a flat surface. However, the slanted surface 27*es* may be constructed as a curved surface having a suitable curvature.

The filter 26 is mounted in place by a structure in which it is inserted or press-fitted inside or outside of the main body 23. However, the present invention is not limited to such a structure, but may employ various structures including a structure in which the filter 26 and the main body 23 are secured to each other by threaded engagement, a structure in which the filter 26 and the main body 23 are appropriately fitted together by recessed and projected shapes formed therebetween, or the like, for example.

In the above embodiments, the second facet 26*d* of the filter 26 is of a circular shape. However, the second facet 26*d* may be of a polygonal shape, for example, rather than the circular shape.

In the fifth embodiment, the oil jet device 20 is of a structure having two nozzle pipes 21. However, the oil jet device 20 may be of a structure having three or more nozzle pipes 21.

I claim:

1. An oil jet device comprising:

a main body mounted on an internal combustion engine and having a fluid communication passage held in fluid communication with an oil passageway defined in said internal combustion engine;

a nozzle pipe having an oil ejection port configured to eject oil that has passed through said fluid communication passage;

a check valve configured to open and close said fluid communication passage when a valve body and a valve seat which are disposed in said main body abut against each other; and a filter having a fluid communication hole configured to pass the oil therethrough and filter the oil, said filter being disposed upstream of said check valve and disposed in or on said main body, wherein an inside diameter of said valve seat is smaller than an inside diameter of said filter, and said valve seat has an upstream end wall surface facing at least some of said fluid communication holes, and said upstream end wall surface includes a slanted surface arranged such that a cross-sectional area of an oil channel is progressively smaller in a direction from an upstream region toward a downstream region of the fluid communication passage.

2. The oil jet vice according to claim 1, wherein said filter comprises a bottomed hollow cylinder with an open end at one end of a hollow cylindrical outer circumferential wall thereof and a filter surface with said fluid communication hole at the other end thereof, and said filter is housed in said main body with the outer circumferential wall held in abutment against said upstream end wall surface.

3. The oil jet device according to claim 1, wherein said filter comprises a bottomed hollow cylinder with an open end at one end of a hollow cylindrical outer circumferential wall thereof and a filter surface with said fluid communication hole at the other end thereof, and said filter is positioned such that an outer circumferential wall of a distal end of said main body is inserted in the outer circumferential wall, and said filter surface is held in abutment against an upstream end of said main body.

4. The oil jet device according to claim 1, wherein said valve seat is integrally formed with said main body, said main body includes a valve body housing disposed downstream of said valve seat, said valve body and an elastic body configured to bias said valve body are inserted through an insertion opening of said valve body housing, and a lid member is press-fit in said insertion opening.

5. The oil jet device according to claim 1, wherein said valve seat comprises a member separate from said main body, and an elastic body configured to bias said valve body and said valve body are inserted through an upstream end opening of said fluid communication passage, and said valve seat is press-fit in said upstream end opening.

6. The oil jet device according to claim 5, wherein an inner wall surface that defines said fluid communication passage has a step held in abutment against a downstream end of said valve seat for determining an inserted position of said valve seat.

7. The oil jet device according to claim 1, wherein said fluid communication hole comprises a plurality of fluid communication holes defined in said filter surface of said filter in each of outer circumferential and central areas thereof, and a diameter of each of said fluid communication holes is smaller than a diameter of said oil ejection port.

8. The oil jet device according to claim 1, wherein said main body has an externally threaded surface on the outer circumference of a tubular portion thereof, said internal combustion engine has an internally threaded surface into which said externally threaded surface is threaded, and said main body is fastened and secured to said internal combustion engine by threaded engagement between said externally threaded surface and said internally threaded surface.

* * * * *